US007507117B2

(12) United States Patent
Amidon

(10) Patent No.: US 7,507,117 B2
(45) Date of Patent: Mar. 24, 2009

(54) TIGHTENING INDICATOR FOR COAXIAL CABLE CONNECTOR

(75) Inventor: Jeremy Amidon, Onondaga, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/735,449

(22) Filed: Apr. 14, 2007

(65) Prior Publication Data

US 2008/0254678 A1 Oct. 16, 2008

(51) Int. Cl.
*H01R 9/05* (2006.01)

(52) U.S. Cl. ..... 439/584; 439/488

(58) Field of Classification Search ..... 439/488–490, 439/578–585

See application file for complete search history.

(56) References Cited

U.S. PATENT DOCUMENTS

| | | | | |
|---|---|---|---|---|
| 4,655,159 | A * | 4/1987 | McMills | 116/212 |
| 4,854,893 | A | 8/1989 | Morris | |
| 4,923,412 | A | 5/1990 | Morris | |
| 5,340,163 | A | 8/1994 | Merrer et al. | |
| 5,352,127 | A | 10/1994 | Muller et al. | |
| 6,093,043 | A * | 7/2000 | Gray et al. | 439/352 |
| D436,076 | S | 1/2001 | Montena | |
| 6,561,841 | B2 | 5/2003 | Norwood et al. | |
| 6,619,876 | B2 * | 9/2003 | Vaitkus et al. | 403/349 |
| 6,716,062 | B1 * | 4/2004 | Palinkas et al. | 439/578 |
| 6,905,365 | B1 * | 6/2005 | Liu | 439/578 |
| 6,921,283 | B2 | 7/2005 | Zahlit et al. | |
| D517,018 | S | 3/2006 | Montena | |
| 7,029,326 | B2 | 4/2006 | Montena | |
| 7,048,579 | B2 | 5/2006 | Montena | |
| 2003/0129870 | A1 | 7/2003 | Norwood et al. | |
| 2005/0037652 | A1 | 2/2005 | Zahlit et al. | |

FOREIGN PATENT DOCUMENTS

| | | | |
|---|---|---|---|
| EP | 1122835 | A1 | 8/2001 |

* cited by examiner

*Primary Examiner*—Edwin A. Leon
(74) *Attorney, Agent, or Firm*—Pastel Law Firm; Christopher R. Pastel

(57) ABSTRACT

A coaxial cable connector includes an outer body, an inner body, a post interconnected with the inner body, a plurality of threads inside a first end of the outer body, and a compression sleeve disposed to fit between a second end of the outer body and an end of the inner body. The connector further includes a shoulder on an end of the post, a shoulder on an inside of the outer body, and a spring disposed between the shoulder of the post and the shoulder of the outer body. When the connector is not is not screwed completely onto an equipment port, a visible indicator on the compression sleeve is not visible to a user, but when the connector is screwed completely onto the equipment port, the connector becomes visible to the user.

5 Claims, 5 Drawing Sheets

TIGHTENING INDICATOR FOR COAXIAL CABLE CONNECTOR

FIELD OF THE INVENTION

This invention relates generally to the field of coaxial cable connectors, and more particularly to a coaxial cable connector with a visual indicator showing when the connector is fully tightened onto an equipment port.

BACKGROUND OF THE INVENTION

With CATV (cable television) technology, it is extremely important to ensure that all connections are tight in order to prevent unwanted interference from getting into the transmission path. For bidirectional systems, it has been estimated that 70%-95% of the unwanted RF interference on the return path, from the subscriber to the headend, originates within the subscriber's premises or home. Because all the return signals funnel back into the headend, a single source of unwanted RF interference (RFI), also known as "ingress", affects the service of all the subscribers. The RFI enters the system from improperly installed F-connectors, cracked or improperly shielded coaxial cable, or simply bad shielding around a television set's tuner. Improper installation includes the failure to tighten fully the connector into an equipment port, thus causing signal leakage and intermittent grounding.

Cable operators are spending enormous amounts of money and resources to maintain the headend plant free from the RFI caused by loose and improper connections. New digital products such as VOIP (voice over internet protocol) are extremely sensitive to RFI ingress. Small levels of ingress can disrupt voice service or cause dropped calls.

SUMMARY OF THE INVENTION

Briefly stated, a coaxial cable connector includes an outer body, an inner body, a post interconnected with the inner body, a plurality of threads inside a first end of the outer body, and a compression sleeve disposed to fit between a second end of the outer body and an end of the inner body. The connector further includes a shoulder on an end of the post, a shoulder on an inside of the outer body, and a spring disposed between the shoulder of the post and the shoulder of the outer body. When the connector is not is not screwed completely onto an equipment port, a visible indicator on the compression sleeve is not visible to a user, but when the connector is screwed completely onto the equipment port, the connector becomes visible to the user.

According to an embodiment of the invention, a coaxial cable connector includes an outer body; an inner body; a post interconnected with the inner body; a plurality of threads inside a first end of the outer body; a shoulder on an end of the post; a shoulder on an inside of the outer body; a spring disposed between the shoulder of the post and the shoulder of the outer body; a compression sleeve disposed to fit between a second end of the outer body and an end of the inner body; a combination of the post, the inner body, and the compression sleeve movable within the outer body between a first position and a second position; wherein the first position is equivalent to a state in which the connector is not screwed completely onto an equipment port, and wherein the second position is equivalent to a state in which the connector is screwed completely onto the equipment port; and wherein when the combination is in the second position, an indicator on the compression sleeve extends outward beyond an edge of the second end of the outer body such that the indicator is visible to a user.

According to an embodiment of the invention, a method of manufacturing a coaxial cable connector includes the steps of: (a) forming an outer body; (b) forming an inner body; (c) forming and interconnecting a post with the inner body; (d) forming a plurality of threads inside a first end of the outer body; (e) forming a shoulder on an end of the post; (f) forming a shoulder on an inside of the outer body; (g) disposing a spring between the shoulder of the post and the shoulder of the outer body; (h) providing a compression sleeve; and (i) fitting the compression sleeve between a second end of the outer body and an end of the inner body; wherein a combination of the post, the inner body, and the compression sleeve are movable within the outer body between a first position and a second position; wherein the first position is equivalent to a state in which the connector is not screwed completely onto an equipment port, and the second position is equivalent to a state in which the connector is screwed completely onto the equipment port; and wherein when the combination is in the second position, an indicator on the compression sleeve extends outward beyond an edge of the second end of the outer body such that the indicator is visible to a user.

DETAILED DESCRIPTION OF THE PREFERRED EMBODIMENT

Figure 1:
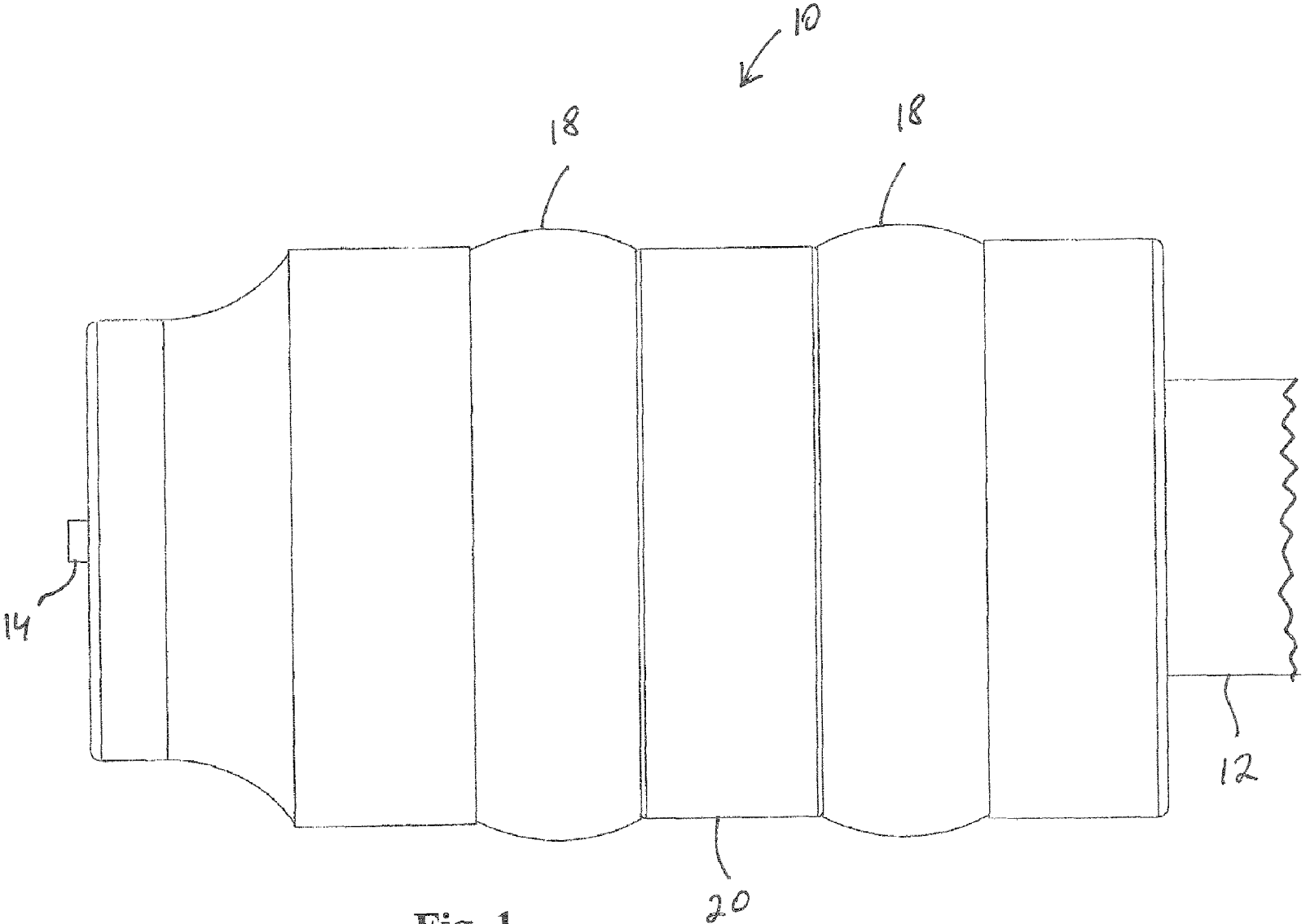
FIG. 1 shows a side elevation view of a coaxial cable connector according to an embodiment of the invention before the connector is tightened onto an equipment port.

Referring to FIG. 1, a coaxial cable connector according to an embodiment of the invention is shown. Connector 10 is shown connected to a coaxial cable 12, which connection leaves a center conductor 14 of coaxial cable 12 positioned to make contact with a signal input (not shown) of an equipment port (not shown) when connector 10 is connected into the equipment port. A plurality of elastomeric rings 18 are preferably around parts of outer body 20. Elastomeric rings 18 increase the ease of tightening connector 10 to the equipment port. Connector 10 is shown in an un-tightened state, that is, connector 10 is not screwed onto the equipment port.

Figure 2:
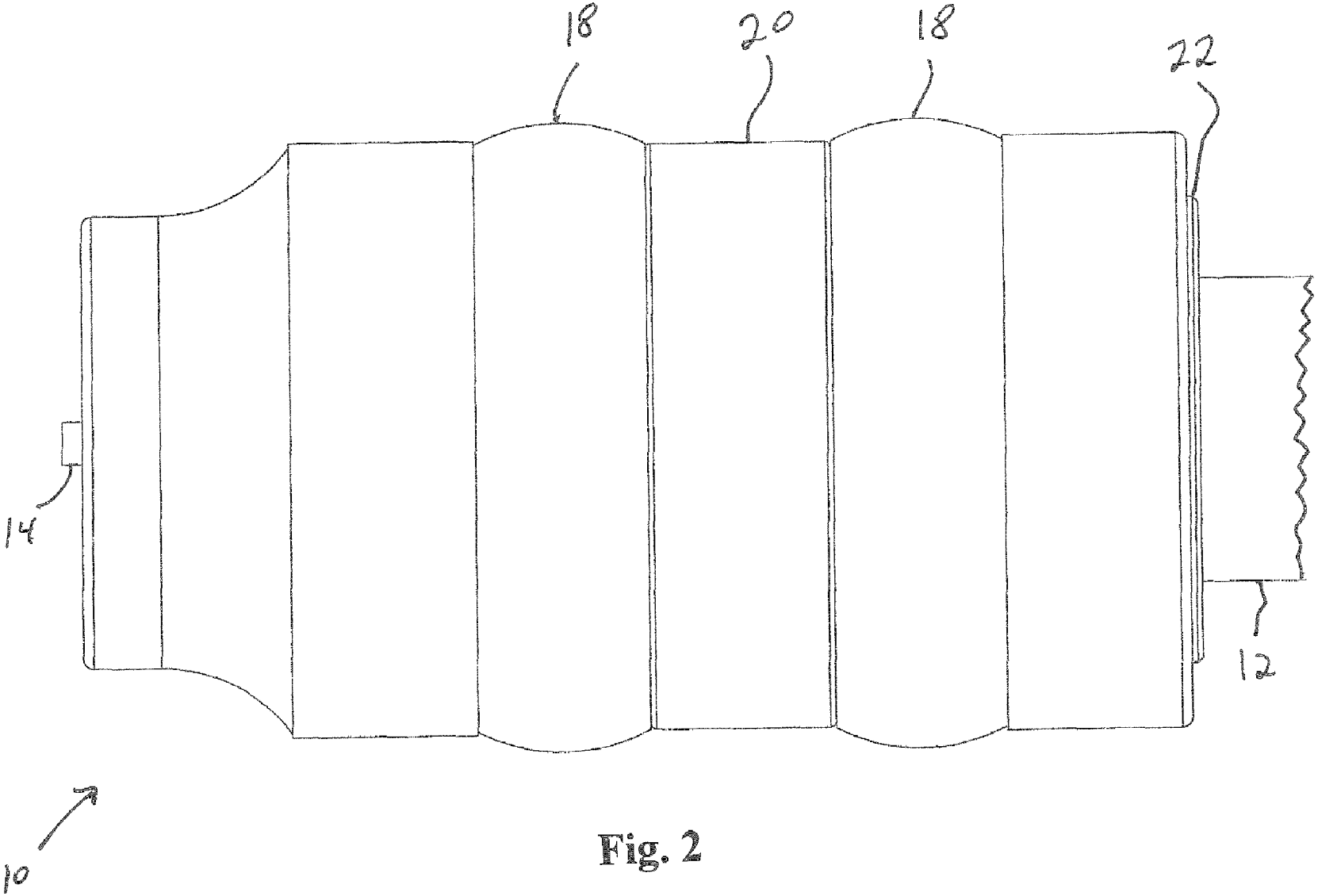
FIG. 2 shows a side elevation view of a coaxial cable connector according to an embodiment of the invention as the connector is tightened onto an equipment port.

Referring to FIG. 2, connector 10 is shown in either a partially tightened state according to one embodiment of the invention, or in a fully tightened state in another embodiment of the invention. Part of a compression sleeve 22 is now visible as it extends past outer body 20.

Figure 3:
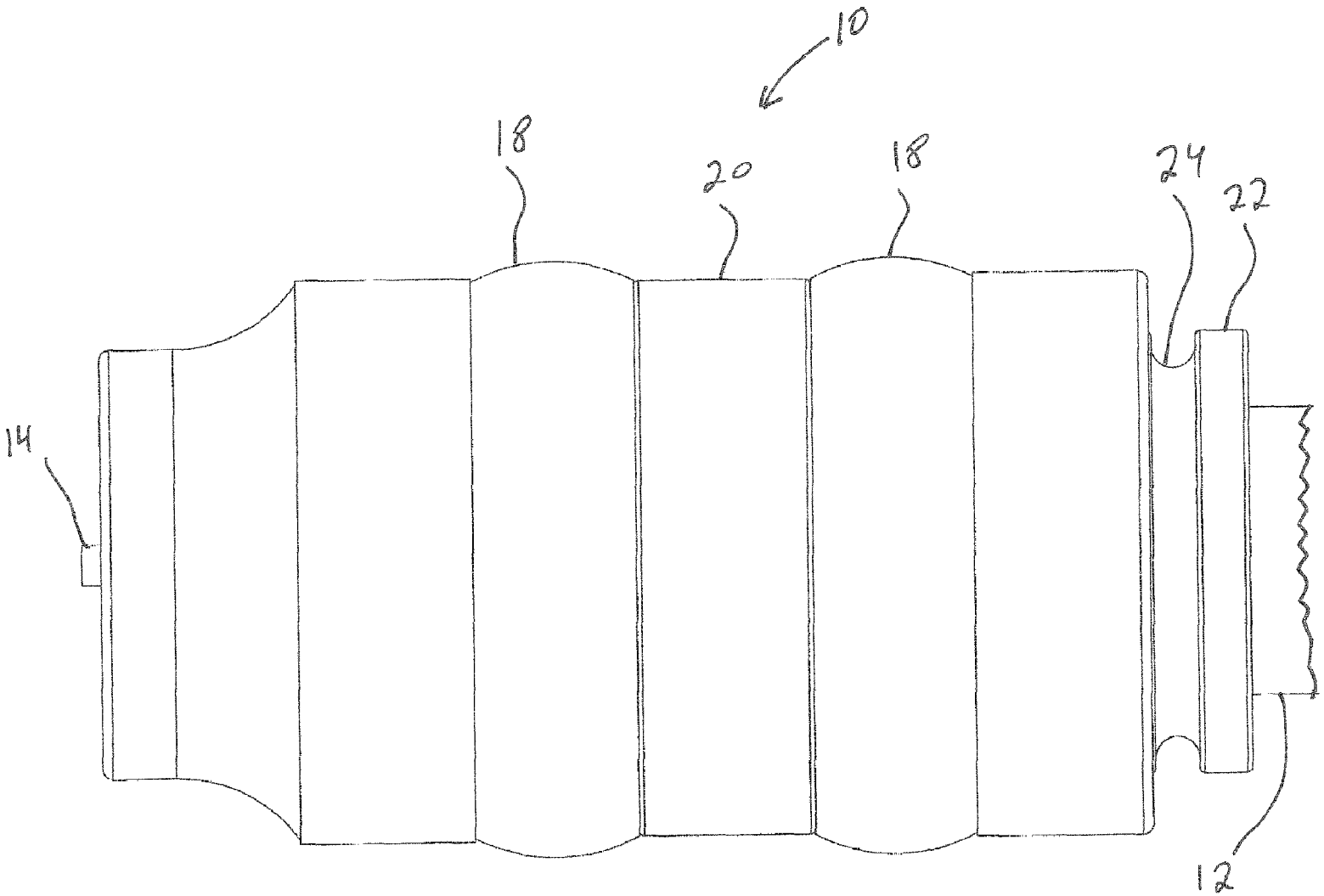
FIG. 3 shows a side elevation view of a coaxial cable connector according to an embodiment of the invention after the connector is fully tightened onto an equipment port.

Referring to FIG. 3, a groove 24 in compression sleeve 22 is now visible as it extends past outer body 20. For the embodiment where FIG. 2 represents a partially tightened state, the embodiment in FIG. 3 represents the fully tightened state. Otherwise, FIGS. 2 and 3 represent different embodiments with different visible indicators, i.e., in the embodiment of FIG. 2, the visible indicator of the fully tightened state is the appearance of a part of compression sleeve 22, while in the embodiment of FIG. 3, the visible indicator of the fully tightened state is the appearance of groove 24.

Figure 4:
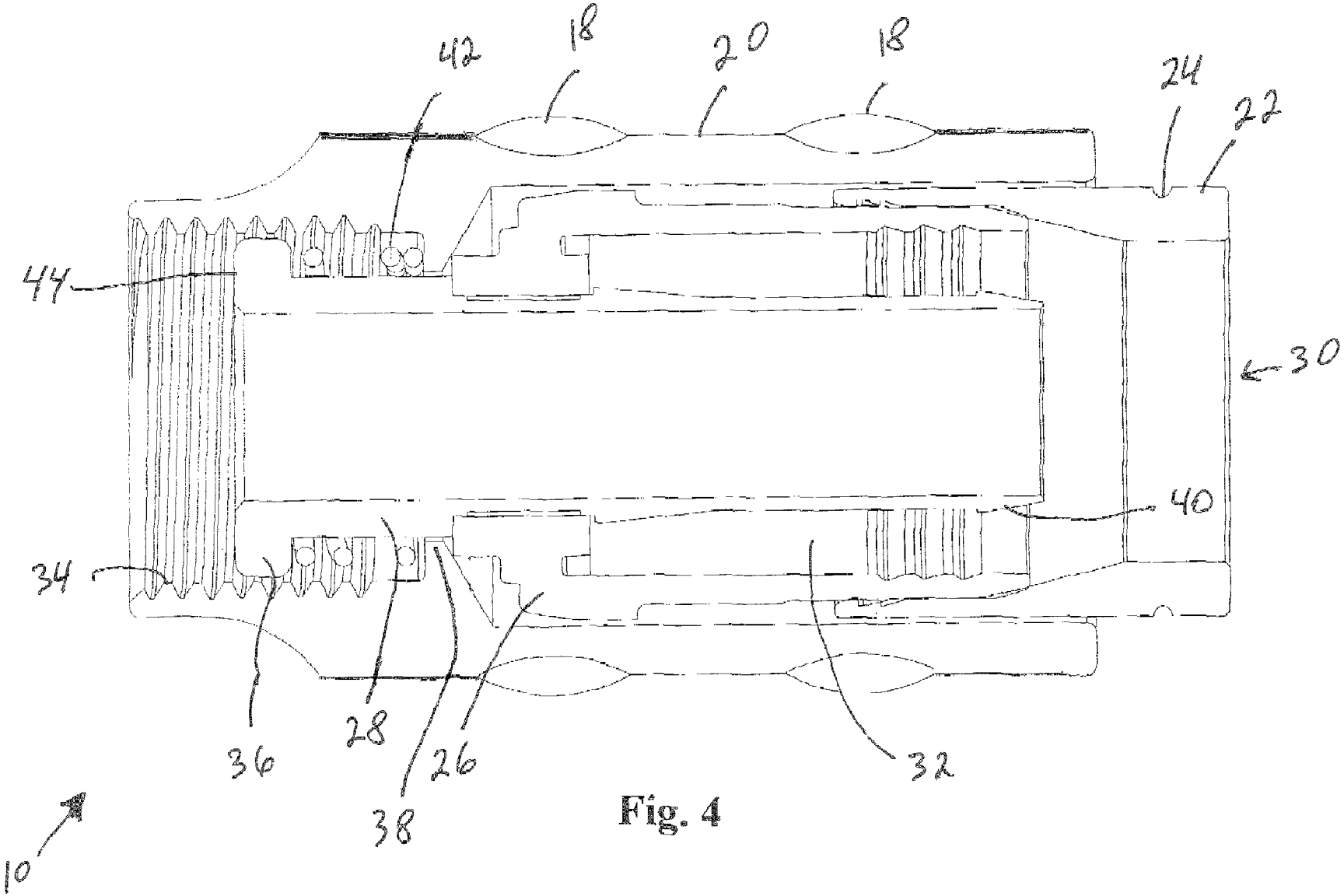
FIG. 4 shows a cutaway view of a coaxial cable connector according to an embodiment of the invention, with the connector not fastened (uncompressed) to a coaxial cable.

Referring to FIG. 4, a cutaway view of an embodiment of the invention is shown, with connector 10 in this embodiment shown in both the uncompressed state and the untightened state. "Uncompressed state" in this embodiment means that the compression sleeve has not been compressed into outer body 20, while "untightened state" continues to mean that connector 10 is not fastened onto the equipment port (not shown). When coaxial cable 12 (FIGS. 1-3) is installed, a prepared end of cable 12 is inserted through an opening 30, with a dielectric (not shown) and center conductor 14 (FIGS. 1-3) passing through a post 28, while an outer braid (not shown) and an outer covering (not shown) of cable 12 fit into a cavity 32. A tip 40 of post 28 passes between the dielectric and the outer braid of cable 12.

Figure 5:
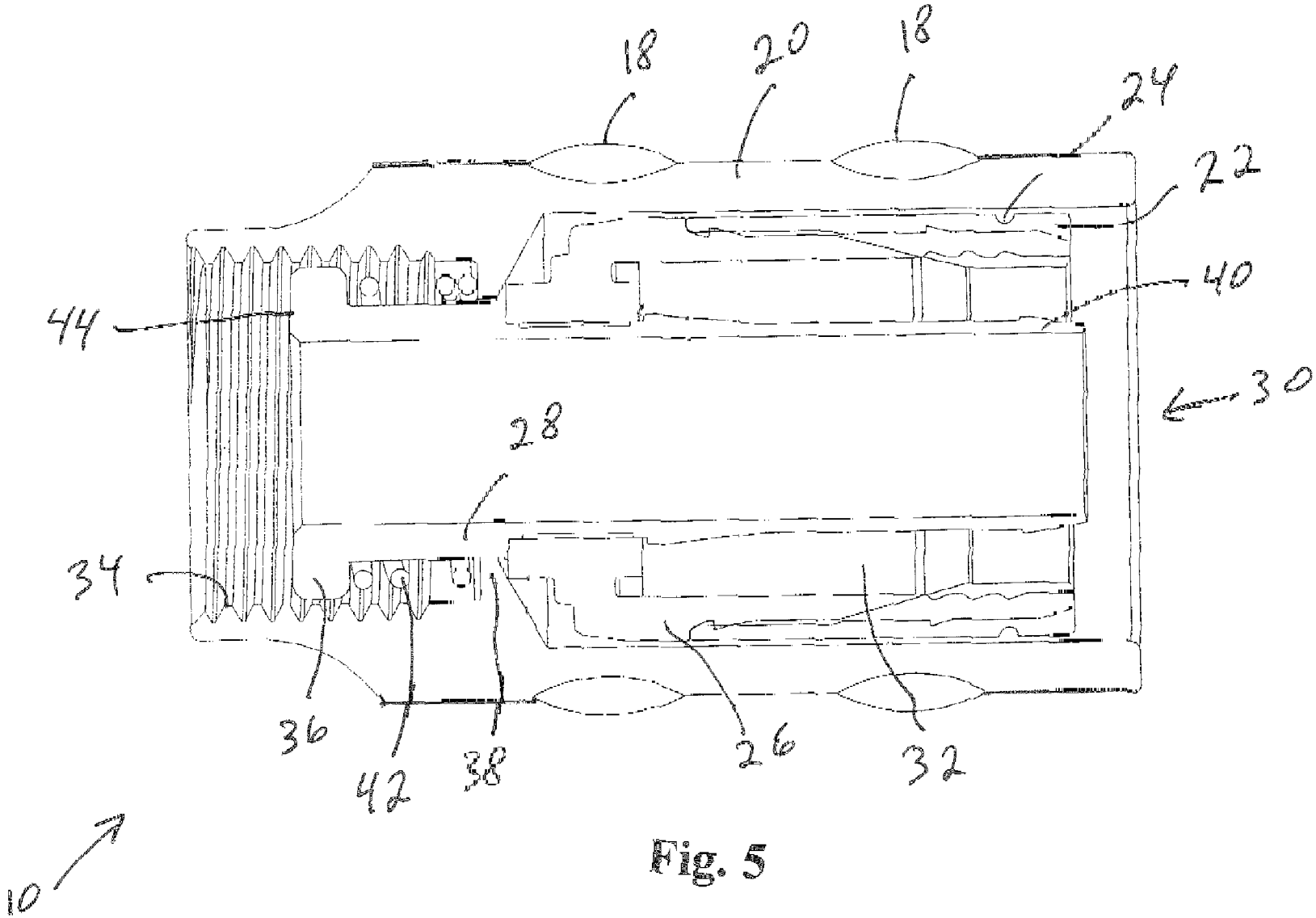
FIG. 5 shows a cutaway view of a coaxial cable connector according to an embodiment of the invention, with the connector fastened (compressed) to a coaxial cable but not tightened onto an equipment port.

Referring to FIG. 5, a cutaway view of an embodiment of the invention is shown, with connector 10 shown in both the compressed state and the untightened state. Note that compression sleeve 22 has been pushed between outer body 20 and inner body 26, compressing inner body 26 against the outer covering (not shown) of cable 12. Once cable 12 is properly connected to connector 10, connector 10 may be connected to the equipment port (not shown). Connector 10 is screwed onto the equipment port (not shown), with threads 34 on a portion of an inside of outer body 20 screwing into corresponding grooves (not shown) on the equipment port (not shown). As connector 10 is screwed onto the equipment port (not shown), an end 44 of post 28 is pushed by the equipment port (not shown), thus forcing a shoulder 36 of post 28 preferably against a spring 42 which in turn is forced against a shoulder 38 of outer body 20. As connector 10 becomes fully tightened onto the equipment port (not shown), the combination of post 28, inner body 26, and compression sleeve 22 moves with relation to outer body 20 so that eventually, in one embodiment, groove 24 on compression sleeve 22 is visible outside outer body 22 as shown in FIG. 3. In another embodiment, when connector 10 is fully tightened onto the equipment port (not shown), part of compression sleeve 22 appears outside outer body 22 as shown in FIG. 2.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A coaxial cable connector attached to a coaxial cable connector, comprising:

an outer body;

an inner body;

a post interconnected with the inner body;

a plurality of threads inside a first end of the outer body;

a shoulder on an end of the post;

a shoulder on an inside of the outer body adjacent the plurality of threads;

a spring disposed between the shoulder of the post and the shoulder of the outer body;

a compression sleeve disposed to fit between a second end of the outer body and an end of the inner body;

a combination of the post, the inner body, and the compression sleeve movable within the outer body between a first position and a second position, and between the second position and the first position;

wherein the first position is equivalent to a state in which the connector is not screwed completely onto an equipment port, and wherein the second position is equivalent to a state in which the connector is screwed completely onto the equipment port;

wherein when the combination is in the first position, an indicator on the compression sleeve does not extend outward beyond an edge of the second end of the outer body such that the indicator is not visible to a user; and wherein when the combination is in the second position, the indicator on the compression sleeve extends outward beyond the edge of the second end of the outer body such that the indicator is visible to the user.

2. A coaxial cable connector according to claim 1, wherein the indicator is an edge of the compression sleeve.

3. A coaxial cable connector according to claim 1, wherein the indicator is a groove in the compression sleeve.

4. A method of manufacturing a coaxial cable connector, comprising the steps of:

forming an outer body;

forming an inner body;

forming and interconnecting a post with the inner body;

forming a plurality of threads inside a first end of the outer body;

forming a shoulder on an end of the post;

forming a shoulder on an inside of the outer body adjacent the plurality of threads;

disposing a spring between the shoulder of the post and the shoulder of the outer body;

providing a compression sleeve;

fitting the compression sleeve between a second end of the outer body and an end of the inner body;

wherein a combination of the post, the inner body, and the compression sleeve are movable within the outer body between a first position and a second position, and between the second position and the first position;

wherein the connector is attached to a coaxial cable connector before being connected to an equipment port;

wherein the first position is equivalent to a state in which the connector is not screwed completely onto the equipment port, and wherein the second position is equivalent to a state in which the connector is screwed completely onto the equipment port;

wherein when the combination is in the first position, an indicator on the compression sleeve does not extend outward beyond an edge of the second end of the outer body such that the indicator is not visible to a user; and wherein when the combination is in the second position, the indicator on the compression sleeve extends outward beyond the edge of the second end of the outer body such that the indicator is visible to the user.

5. A method according to claim 4, further comprising the step of forming a groove on an end of the compression sleeve, wherein the groove is the indicator.

* * * * *